US008371708B2

(12) United States Patent
Nagasaka et al.

(10) Patent No.: US 8,371,708 B2
(45) Date of Patent: Feb. 12, 2013

(54) ELECTRIC POWER TOOL

(75) Inventors: Hidenori Nagasaka, Anjo (JP); Masahiro Watanabe, Anjo (JP); Kazuya Kimura, Anjo (JP)

(73) Assignee: Makita Corporation, Anjo (JP)

( * ) Notice: Subject to any disclaimer, the term of this patent is extended or adjusted under 35 U.S.C. 154(b) by 345 days.

(21) Appl. No.: 12/934,493

(22) PCT Filed: Jan. 19, 2009

(86) PCT No.: PCT/JP2009/050648
§ 371 (c)(1),
(2), (4) Date: Oct. 5, 2010

(87) PCT Pub. No.: WO2009/119141
PCT Pub. Date: Oct. 1, 2009

(65) Prior Publication Data

US 2011/0025207 A1 Feb. 3, 2011

(30) Foreign Application Priority Data

Mar. 26, 2008 (JP) ..... 2008-080607

(51) Int. Cl.
*B25B 23/18* (2006.01)

(52) U.S. Cl. ..... 362/109; 318/3; 362/119; 173/217; 173/213; 173/162.2; 320/114

(58) Field of Classification Search ..... 318/3; 362/119, 362/109; 173/217, 213, 162.2; 320/114
See application file for complete search history.

(56) References Cited

U.S. PATENT DOCUMENTS

| | | | | |
|---|---|---|---|---|
| 4,619,162 | A * | 10/1986 | Van Laere | 81/464 |
| 4,822,958 | A * | 4/1989 | Van Laere | 200/1 V |
| 5,076,805 | A * | 12/1991 | Welch | 439/568 |
| 5,169,225 | A * | 12/1992 | Palm | 362/118 |
| 6,168,287 | B1 * | 1/2001 | Liu | 362/119 |
| 6,502,949 | B1 * | 1/2003 | Horiyama et al. | 362/119 |
| 6,890,135 | B2 * | 5/2005 | Kopras et al. | 409/182 |
| 6,979,155 | B2 * | 12/2005 | Dils et al. | 408/16 |
| 7,249,862 | B2 * | 7/2007 | Shirane | 362/119 |
| 7,311,424 | B1 * | 12/2007 | McCarthy | 362/376 |

(Continued)

FOREIGN PATENT DOCUMENTS

| | | |
|---|---|---|
| JP | U-4-45608 | 4/1992 |
| JP | A-11-058111 | 3/1999 |
| JP | A-2001-300867 | 10/2001 |
| JP | A-2001-300868 | 10/2001 |
| JP | A-2002-205285 | 7/2002 |

OTHER PUBLICATIONS

International Search Report in International Application No. PCT/JP2009/050648, dated Feb. 10, 2009 (with English translation).

*Primary Examiner* — Rita Leykin
(74) *Attorney, Agent, or Firm* — Oliff & Berridge, PLC

(57) ABSTRACT

An electric power tool can include a main body, which rotates a motor with a pull operation of the switch lever and actuates a head tool by a rotative force of the motor, and an auxiliary tool configured for attaching and detaching to and from the electric power tool main body. In the main body, an actuating part actuated with the pull operation of the switch lever is provided. The auxiliary tool includes a detecting part, which noncontactly detects an actuation of the actuating part, and an electric circuit section for actuating electric devices, provided in the auxiliary part, by a detecting actuation of the detecting part.

5 Claims, 5 Drawing Sheets

U.S. PATENT DOCUMENTS 7,357,526 B2 * 4/2008 Zeiler ..... 362/119
7,363,685 B2 * 4/2008 Walker et al. ..... 16/430
7,490,746 B2 * 2/2009 Sakai et al. ..... 224/269
7,557,536 B2 * 7/2009 Lobert et al. ..... 320/114
7,621,652 B2 * 11/2009 Zick ..... 362/183
7,766,097 B2 * 8/2010 Kondo ..... 173/217
7,934,847 B2 * 5/2011 Oomori et al. ..... 362/119

* cited by examiner

ELECTRIC POWER TOOL

BACKGROUND OF THE INVENTION

1. Field of the Invention

The present invention relates to an electric power tool including an electric power tool main body that drives a tool bit by a rotative force of a motor that rotates with a pull operation of a switch lever, and including an auxiliary tool that can be attached and detached to and from the electric power tool main body.

2. Background Art

An electric power tool described in Japanese Laid-Open Patent Publication No. 2002-205285 includes an electric power tool main body that drives a tool bit with a rotative force of a motor that rotates by a pull operation of a switch lever, and includes an auxiliary handle that is constructed to be attached and detached to and from the electric power tool main body. A lamp is attached to the auxiliary handle via a flexible extension member, and a switch of the lamp is provided at a leading end part of the auxiliary handle. As a result, an illumination direction can be adjusted with the extension member and a workpiece to be processed and the tool bit can be illuminated during operations.

In the electric power tool described above, the switch of the lamp is provided at the auxiliary handle. As a result, it is necessary to operate the switch of the lamp separately from an operation of the electric power tool main body, and thus the operation of the switch of the lamp is sometimes troublesome.

Thus, there is a need in the art to actuate electric devices in the auxiliary tool attached to the electric power tool main body in conjunction with an operation of the switch lever in the electric power tool main body in order to improve usability of the electric devices.

SUMMARY

The first invention is an electric power tool including an electric power tool main body that drives a tool bit with a rotative force of a motor that rotates by a pull operation of a switch lever, and also including an auxiliary tool that is constructed to be attached and detached to and from the electric power tool main body. The invention is characterized in that the electric power tool main body includes an actuating part that is actuated by a pull operation of the switch lever, and the auxiliary tool includes a detecting part for noncontactly detecting an actuation of the actuating part and also includes an electric circuit section for actuating the electric devices, provided in the auxiliary tool, by the detecting actuation of the detecting part.

According to the present invention, the electric power tool main body includes the actuating part that is actuated by a pull operation of the switch lever. Further, the auxiliary tool includes the detecting part that noncontactly detects an actuation of the actuating part and includes an electric circuit part that actuates the electric devices, which is provided in the electric power tool main body, by the detecting actuation of the detecting part. As a result, the electric devices of the auxiliary tool attached to the electric power tool main body can be operated in conjunction with the pull operation of the electric power tool main body. This will improve usability of the electric devices of the auxiliary tool.

In addition, the detecting part of the auxiliary tool can noncontactly detect the actuation of the actuating part of the electric power tool main body, and thus attaching and detaching the auxiliary tool to and from the electric poser tool main body can be easily performed.

According to the second invention, the actuating part of the electric power tool main body is a light emitting device and the detecting part of the auxiliary tool is a light-receiving sensor that can detect the light from the light emitting device.

In this way, since a signal of the pull operation of the switch lever can be transmitted in a form of light, reliability of the transmission of information in a noncontact condition is high.

According to the third invention, the electric device is a lamp that can illuminate a front part of the electric power tool main body.

As a result, the lamp can be turned on by a pull operation of the switch lever, and thus usability of the electric power tool at a dark place can be improved.

According to the forth invention, the auxiliary tool includes a connecting part, which has a ring-shaped member that can tighten the leading end part of the housing of the electric power tool main body from outside in the radial direction, and also includes a battery housing part, which can be rotatably attached to the connecting part around an auxiliary tool axis and in which a battery for the electric circuit part is accommodated. The auxiliary tool further includes a bolt-nut mechanism, which rotates in association with rotation of the battery housing part with respect to the connecting part, and which moves the bolt engaging with the nut in the axial direction and applies a tightening force to the ring-shaped member by the move of the bolt. A through-hole is formed in the axial direction in the nut, through which wires from the electric circuit part are passed.

As a result, when the electric devices are provided at the side of the connection part of the auxiliary tool, a wiring space in the electric circuit part can be ensured without preventing a rotational movement of the battery housing part with respect to the connecting part.

According to the fifth invention, a lamp is attached to a part that surrounds the housing of the electric power tool main body in a circumference direction in the connection part.

And thus, a lamp can be arranged around the housing of the electric power tool main body to easily illuminate around the tool bit.

According to the present invention, since the electric devices of the auxiliary tool attached to the electric power tool main body can be actuated in conjunction with an operation of the switch lever of the electric power tool main body, usability of the electric devices can be improved.

EXPLANATION OF SYMBOLS

Figure 1:
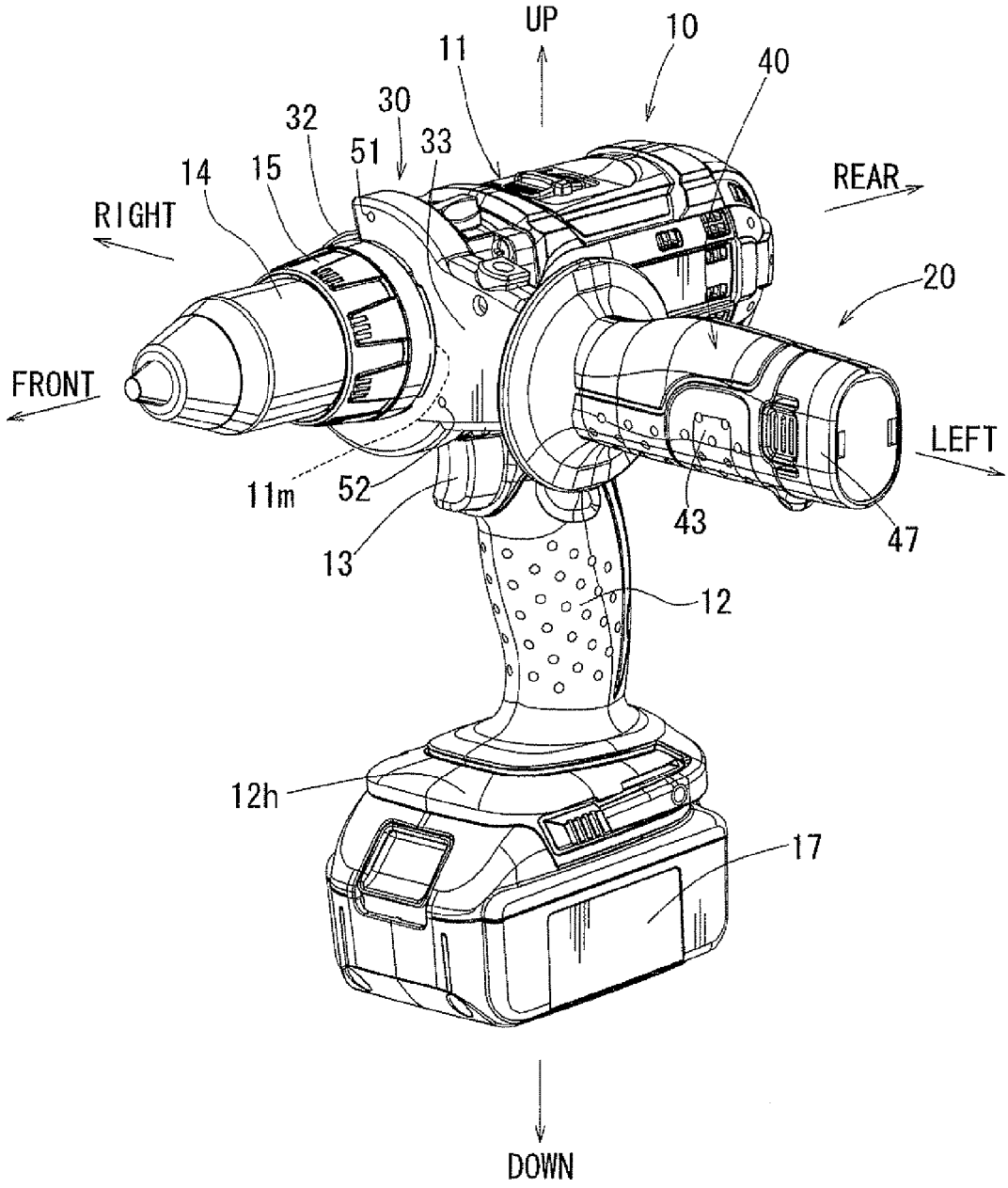
FIG. 1 is a perspective view viewed from a left frontal side of an electric power tool according to an embodiment of the present invention.

10 . . . electric power tool main body
11 . . . housing main body (housing)
11*m* . . . annular groove portion
13 . . . switch lever
19 . . . tool-side LED (actuating part)
20 . . . side handle

25 . . . bolt
25*k* . . . through-hole
27 . . . nut
30 . . . connecting part
32 . . . grip spring
32*e* . . . ring-shaped part
33 . . . case part
40 . . . holding part
47 . . . battery
51 . . . first LED
52 . . . second LED
53 . . . third LED
55 . . . light-receiving sensor (detecting part)

DETAILED DESCRIPTION OF THE INVENTION

Embodiment 1

An embodiment 1 of the present invention will be explained below with reference to FIGS. 1 to 5. An electric power tool of the present embodiment is an electric driver drill having a side handle. A front, rear, left, right, up, and down in the figures correspond to a front, rear, left, right, up, and down of the electric power tool, respectively.

<Outline of Electric Power Tool>

Figure 2:
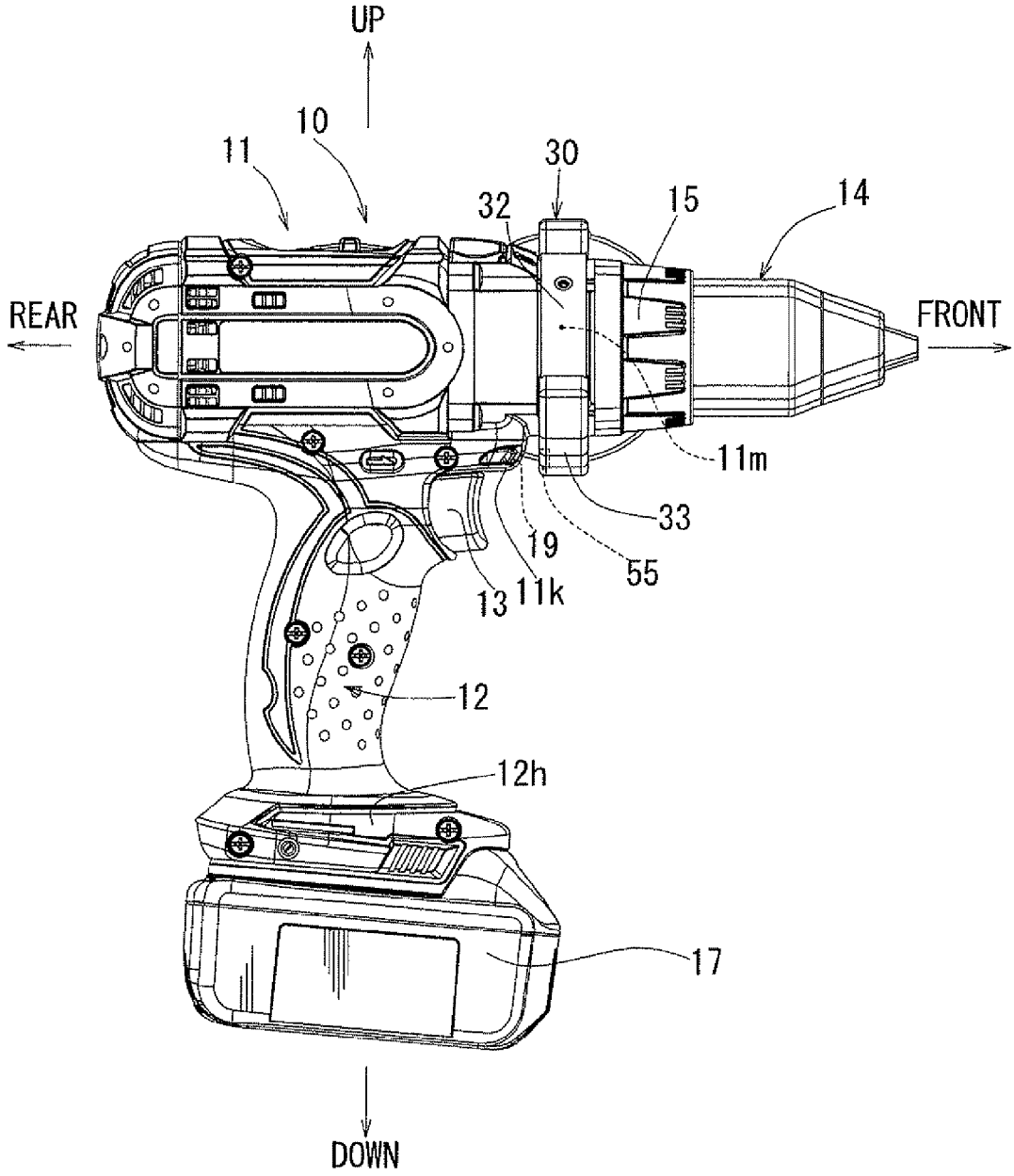
FIG. 2 is a lateral view viewed from a right side of the electric power tool.

As shown in FIG. 1 and FIG. 2, an electric power tool of the present embodiment includes an electric power tool main body 10 and a side handle 20 that is attached to a front portion of a housing main body 11 of the electric power tool main body 10.

The electric power tool main body 10 includes a tubular housing main body 11 and a grip part 12 that is formed to protrude downward from a lower surface side of the housing main body 11. A trigger-type switch lever 13 pulled by fingers of a user is provided at an upper end position (a base end part) of the grip part 12. Further, a battery connection part 12*h*, to which a battery 17 serving as a power source for the electric power tool main body 10 is connected, is provided at a lower end part (a leading end part) of the grip part 12.

A tubular change-ring 15 is attached to a leading end part of the housing main body 11 of the electric power tool main body 10 so as to be rotatable about its axis, in order to adjust a rotation torque of the tool bit (not shown). Further, a leading end part of a spindle (not shown) protrudes in the axial direction from a tip of the change-ring 15, and a chuck 14 for holding the tool bit is attached around the leading end part of the spindle.

Further, an annular groove part 11*m* for attaching the side handle 20 is formed at a rear position of the change-ring 15 in the housing main body 11.

That is, the housing main body 11 corresponds to a housing of the present invention.

As shown in FIG. 2, a rectangular part 11*k* protruding downward in a stepped manner at a rear position of the annular groove part 11*m* is provided at a lower surface of the housing main body 11. Also, an illuminating tool-side LED 19 is housed at a position of the corneous part 11*k*, directing forward.

Figure 5:
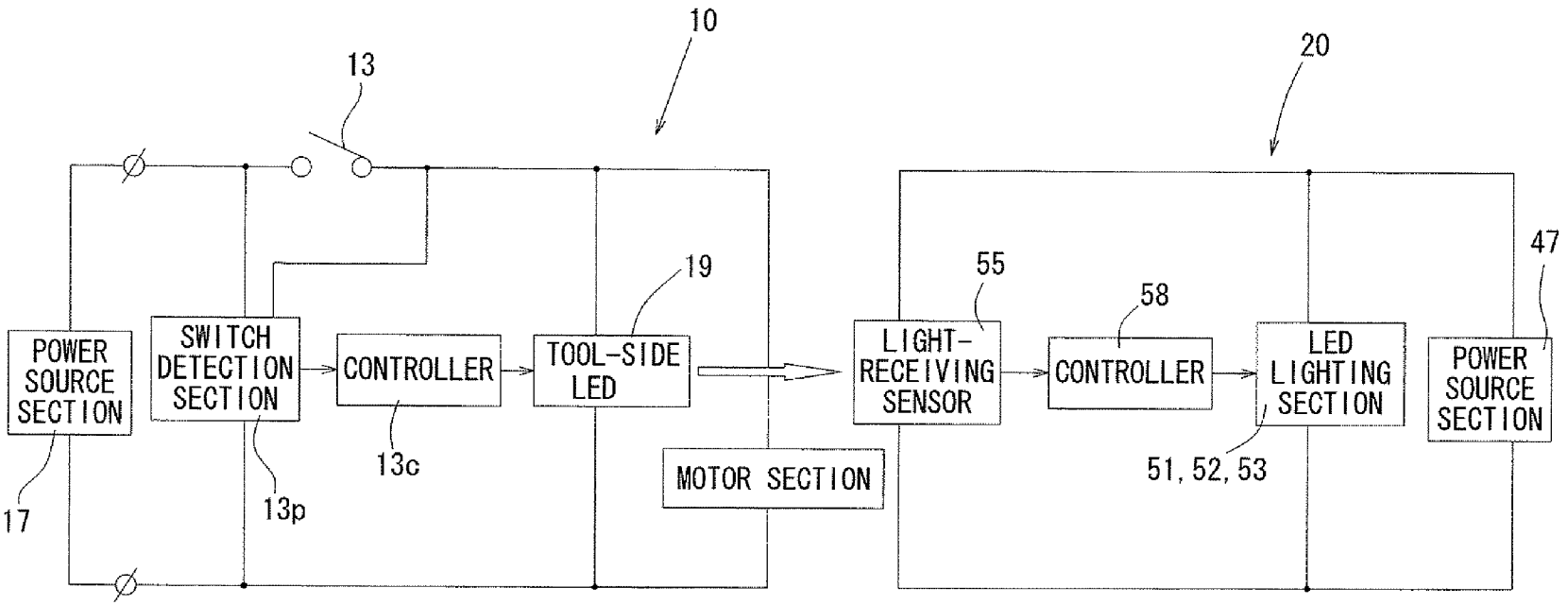
FIG. 5 is a schematic view of an electric circuit for illumination, provided in the electric power tool main body and the side handle.

The tool-side LED 19 is used as a light-emitting device for transmitting a signal, which emits light to a light-receiving sensor 55 of a side handle 20 as described afterward. As shown in the electric circuit diagram of FIG. 5, the tool-side LED 19 is constructed to turn on when the switch lever 13 of the electric power tool main body 10 is pulled and a switch detection section 13*p* is actuated. A controller 13*c* in FIG. 5 is for holding an actuating signal of the switch detection section 13*p* for a predetermined period of time. Further, a power source section represents a battery 17 of the electric power tool main body 10, and a motor section represents the spindle, the chuck 14, a motor for rotating the tool bit, and a driving part for driving the motor.

That is the tool-side LED 19 corresponds to an actuating part of the present invention.

<Side Handle 20>

Figure 3:
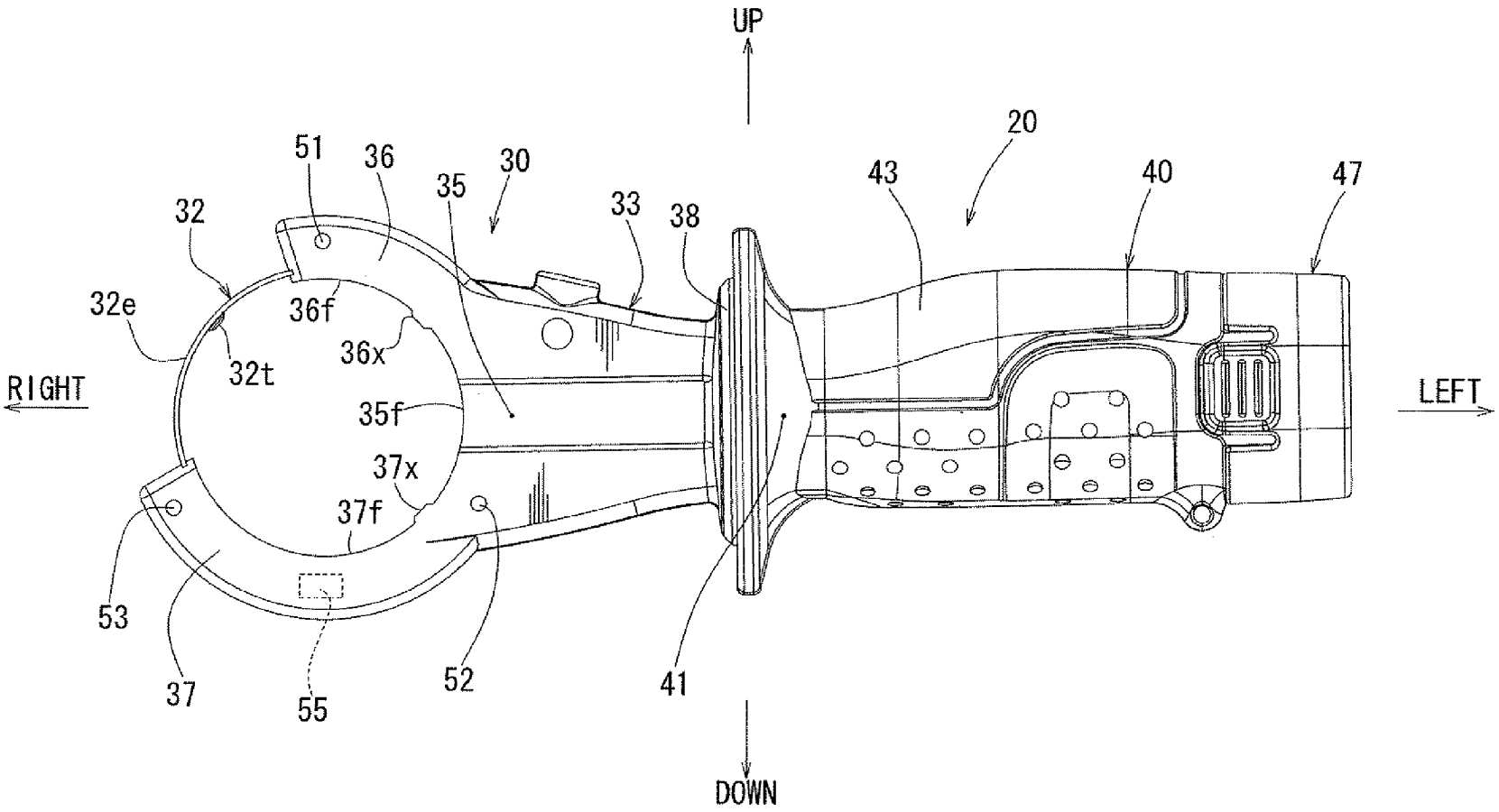
FIG. 3 is an outline view of a side handle.
Figure 4:
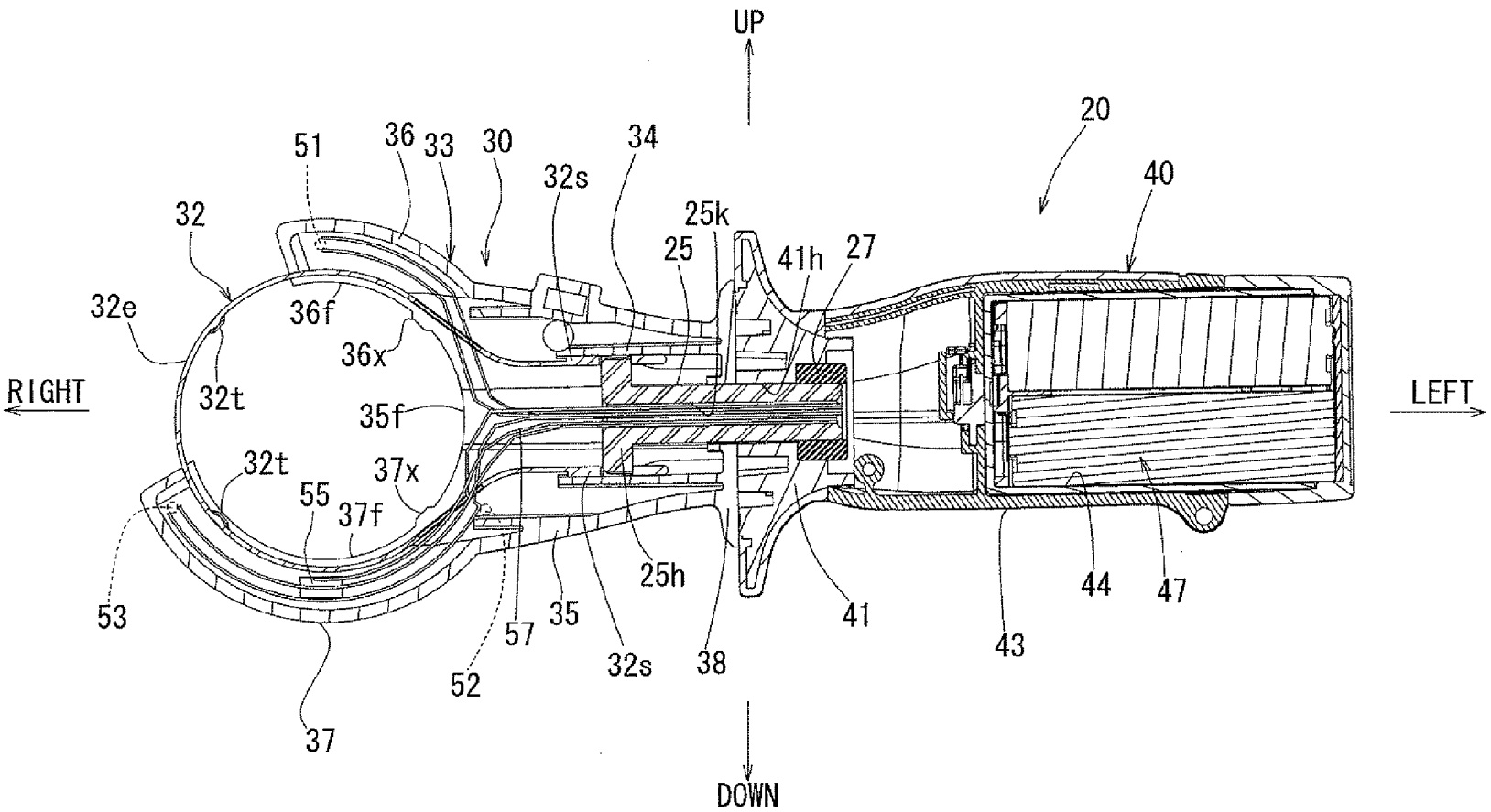
FIG. 4 is a longitudinal cross-sectional view of the side handle.

The side handle 20 is an auxiliary tool used when a user, who holds the grip part 12 of the electric power tool main body 10 with one hand, supports a front portion of the electric power tool 10 with the other hand. As shown in FIG. 3 etc., the side handle 20 includes a connection part 30 and a holding part 40. The connection part 30 is a part for fixing the side handle 20 to the electric power tool main body 10. As shown in FIG. 4, the connection part 30 includes a grip spring 32 formed in a ring-shaped way with a part opened, and also includes a case part 33 that supports the grip spring 32.

The grip spring 32 is a spring like a leaf spring configured for enabling to tighten the annular groove part 11*m*, which is formed in the housing main body 11 of the electric power tool main body 10, from outside in the radial direction. The grip spring 32 includes a ring part 32*e* and parallel plate parts 32*s* that are bent outward in the radial direction at both ends of the ring part 32*e*. Both parallel plate parts 32*s* of the grip spring 32 are slidably accommodated in parallel with each other in a central rectangular tube part 34 (described later) of the case 33 in the axial direction of the auxiliary tool. Further, a hexagonal head part 25*h* of a bolt 25 is slidably accommodated in the central rectangular tube part 34 of the case part 33 in the axial direction, and both the parallel plate parts 32*s* of the grip spring 32 are engaged with the hexagonal head part 25*h* of the bolt 25. That is, both the parallel plate parts 32*s* of the grip spring 32 can move with the bolt 25 in the axial direction.

Further, in an inner circumference surface of the ring part 32*s* of the grip spring 32, a protrusions 32*t* are formed that presses the annular groove part 11*m* of the housing main body 11 from outside in the radial direction.

The case part 33 is configured for accommodating and supporting the grip spring 32, while a part of the circumference of the ring part 32*e* of the grip spring 32 being exposed. As shown in FIG. 3 and FIG. 4, the case part 33 includes a body section 35 that is roughly rectangular in cross-section and coaxially accommodates the above-described central rectangular tubular part 34, an arc-shaped upper arm 36 and a arc-shaped lower arm 37 that are formed at the base end side (a side of the electric power tool main body 10) of the body section 35, and a flange part 38 that is formed at the leading end side of the body section 35. As shown in FIG. 3 and FIG. 4, an inner circumference surface 36*f* of the upper arm 36, an inner circumference surface 37*f* of the lower arm 37, and a base end surface 35*f* of the body section 35 are formed to have arc shapes with the same radius of curvature and consecutive each other. Further, the inner circumference surface 36*f* of the upper arm 36, the inner circumference surface 37*f* of the lower arm 37, and the base end surface 35*f* of the body section 35 are configured for covering the annular groove part 11*m* of the housing main body 11 of the electric power tool main body 10. Further, in the inner circumference surface 36*f* of the upper arm 36 and inner circumference surface 37*f* of the lower arm 37, protrusions 36*x* and 37*x* are formed for pressing the annular groove part 11*m* of the housing main body 11 from outside in the radial direction.

A first LED 51, a second LED 52, and a third LED 53 used for illumination are mounted on a leading end part of the upper arm 36, a base end part (a boundary position with the body section 35) of the lower arm 37, and a leading end part of the lower arm 37 at a front surface side of the case part 33 (a front side in FIG. 3), respectively, and are directed forward.

Further, as shown in FIG. 2 and FIG. 4, a light-receiving sensor 55 for receiving a light from the above-described tool-side LED 19 is mounted on a central part of the lower arm 37 at a back surface side of the case part 33. That is, the light-receiving sensor 55 corresponds to a detecting part of the present invention.

As shown in FIG. 4, lead wires 57 for the first LED 51, the second LED 52, the third LED 53, and the light-sensitive sensor 55 are guided to the side of a holding part 40, passing through a through-hole 25*k* that is formed in the axial center direction of the bolt 25.

The holding part 40 is a part in the side handle 20 that a user actually holds. The holding part 40 includes a flange part 41, which is connected to the flange part 38 of the case part 33 so as to be rotatable about its axis, a holding main body part 43, and a battery case 47 as a power source for an electric circuit section for illumination. As shown in FIG. 4, a through-hole 41*h* for passing the bolt 25 of the case part 33 is formed in the flange part 41 of the holding part 40, and a nut 27 for engaging with the bolt 25 is fixed to an end part of the through-hole 41*h*. Thus, by rotating the holding part 40 around the axial center relative to the case part 33, the nut 27 is engaged with the bolt 25, and the bolt 25 moves in the axial direction. Hence, the bolt 25 moves both the parallel plate parts 32*s* of the grip spring 32 back and forth in the axial direction, and the grip spring 32 can tighten or loosen the annular groove part 11*m* of the housing body part 11.

That is, the grip spring 32 corresponds to a ring member of the present invention, and the bolt 25 and the nut 27 correspond to a bolt-nut mechanism of the present invention.

As shown in FIG. 4, a battery housing part 44 for housing the battery case 47 is provided in the holding main body part 43 of the holding part 40.

As shown in FIG. 5, the electric circuit section for illumination includes the light-receiving sensor 55, a controller 58, the first LED 51, the second LED 52, the third LED 53, an LED lighting section having a switching element, and the power source section (battery case) 47. When the light-receiving sensor 55 receives light from the tool-side LED 19 to turn on, the ON signal is inputted to the controller 58. The controller 58 holds the ON signal for a predetermined period of time, and outputs the ON signal held for the period of time to the switching element of the LED lighting section. Thus, the switching element becomes conductive for the predetermined period of time, and the first LED 51, the second LED 52, and the third LED 53 are turned on.

That is, the holding part 40 corresponds to a battery housing part of the present invention.

<Use of Electric Power Tool>

When the electric power tool is used, the side handle 20 is attached to the electric power tool main body 10.

In this case, at first, by rotating the holding part 40 of the side handle 20 counterclockwise with respect to the case part 33 of the connection part 30, the bolt 25 is moved in a direction in which the grip spring 32 is pushed. In this way, an inside diameter of the annular part, constituted by the grip spring 32, the upper arm 36 and the lower arm 37 of the case part 33, and the base end surface 35*f* of the body section 35, becomes large to allow passage of the leading end part of the housing body part 11 of the electric power tool main body 10. Next, the leading end part of the housing body part 11 is passed through the grip spring 32 etc. of the side handle 20 so that the tool-side LED 19, which is provided in the housing main body 11 of the electric power tool main body 10, faces the light-receiving sensor 55 provided in the case part 33 of the side handle 20. And then, the holding part 40 of the side handle 20 is turned clockwise with respect to the case part 33 of the connection part 30. Thus, the bolt 25 is moved in a direction in which the grip spring 32 is pulled, and the grip spring 32 can tighten the annular groove part 11*m* of the housing main body 11 of the electric power tool main body 10. Then, attaching the side handle 20 to the electric power main body 10 is completed.

When the switch lever 13 is pulled in the state that the side handle 20 is attached to the electric power main body 10, the switch detection section 13*p* shown in FIG. 5 is actuated and the tool-side LED 19 is turned on. Further, the motor of the electric power main body 10 rotates, and the spindle and the tool bit of the electric power tool main body 10 rotate.

When the tool-side LED 19 is turned on, the light-receiving sensor 55 receives light from the tool-side LED 19 to be turned on and the ON signal is inputted to the controller 58. The controller 58 outputs the ON signal held for the period of time to the switching element of the LED lighting section and turns on the first LED 51, the second LED 52, and the third LED 53 for the predetermined period of time.

In this way, the first LED, the second LED, and the third LED illuminate a surrounding area of the tool bit and a workpiece to be processed.

<Advantage of Electric Power Tool of the Present Invention>

According to the electric power tool of the present embodiment, the tool-side LED 19 (the actuating part), which is turned on by a pull operation of the switch lever 13, is provided in the electric power tool main body 10. Further, the side handle 20 (the auxiliary tool) includes the light-receiving sensor 55 (the detecting part), which noncontactly detects a lighting actuation of the tool-side LED 19, and the electric circuit section that actuates the first LED 51, the second LED 52, and the third LED 53 provided in the side handle 20, by a detecting actuation of the light-sensitive sensor 55. Thus, in conjunction with a pull operation of the switch lever 13 of the electric power tool 10, the first LED 51, the second LED 52, and the third LED 53 of the side handle 20 attached to the electric power tool main body 10 can be actuated. In this way, usability of the first LED 51, the second LED 52, and the third LED 53 of the side handle 20 can be improved. Further, usability of the electric power tool at a dark place can be improved.

In addition, since the light-sensitive sensor 55 of the side handle 20 can noncontactly detect a lighting actuation of the tool-side LED 19 of the electric power tool main body 10, attaching and detaching the side handle 20 with respect to the electric power tool main body 10 can be easily performed.

Further, since a pull operation signal of the switch lever 13 can be transferred in a form of light, reliability of information transmission in a noncontact condition can be high.

Further, the through-hole 25*k* is formed in the bolt 25 that constitutes a bolt-nut mechanism of the side handle 20, and lead wires 57 for the electric circuit part are passed through the through-hole 25*k*. Thus, even in a case where a lamp is provided at a side of the connection part 30 of the side handle 20 and the battery 47 is accommodated at the holding part 40 side, a wiring space for the electric circuit part can be ensured without preventing rotation of the holding part 40 with respect to the connection part 30.

Further, since the first LED 51, the second LED 52, and the third LED 53 can be arranged around the housing main body 11 of the electric power tool main body 10, a surrounding area of the tool bit can be easily illuminated.

Modification Examples

The present invention may not be limited to the above embodiment, and modifications can be made without departing from its spirit of the present invention. For example, the present embodiment shows that the actuating part at the electric power tool main body 10 side which is actuated by the pull operation of the switch lever 13 is the tool-side LED 19, and the detecting part at the side handle 20 side is the light-receiving sensor 55. However, in place of the tool-side LED 19, it is possible to provide a magnet at a one position around the circumference of the chuck 14 and to use a magnetic sensor in place of the light-receiving sensor 55 in order to detect the pull operation signal of the switch lever 13 based on rotation of the chuck 14. It is also possible to provide a sound-receiving microphone for detecting a sound of motor rotation or a gearing sound (vibration) of the electric poser tool main body 10 as a detecting part at the side handle 20 side in order to detect a signal of the pull operation of the switch lever 13.

Further, the exemplified embodiment shows that the entire holding part 40 rotates with respect to the connection part 30 of the side handle 20 to tighten the grip spring 32. However, it is also possible to rotate only the flange part 41 of the holding part 40 in order to tighten the grip spring 32. Thus, twisting of the lead wires 57 that are passed through the through-hole 25*k* of the bolt 25 can be prevented.

Further, the exemplified embodiment shows that the battery case 47 of the electric circuit part for illumination is located in the holding part 40 of the side handle 20. However, it is also possible to use a button battery etc. replacing for the battery case 47 and to locate the button battery etc. inside the case part 33 of the side handle 20. Further, it is also possible to supply a power source for the electric circuit part from a side of the electric power tool main body 10.

Further, the exemplified embodiment shows that the lamps (the first LED 51, the second LED 52, and the third LED 53) at the side handle 20 are turned on by the pull operation of the switch lever 13. However, it is also possible to improve the electric circuit part for illumination such that brightness etc. of the lamps (the first LED 51, the second LED 52, and the third LED 53) are changed based on the number of pull operations of the switch lever 13 for a predetermined period of time.

Further, the exemplified embodiment shows that the lamps (the first LED 51, the second LED 52, and the third LED 53) are used as electric devices of the side handle 20. However, it is also possible to use a distance sensor etc. for detecting a distance to a workpiece to be processed.

Further, the exemplified embodiment shows that the side handle 20 is used as an auxiliary tool. However, in place of the side handle 20, it is also possible to configure to use a device such as a depth gauge for adjusting a depth of a drilling hole of the electric drill.

The invention claimed is:

1. An electric power tool, comprising:

a main body in which a motor rotates from a pull operation of a switch lever and a tool bit rotates via a rotative force of the motor; and an auxiliary tool that can be attached and detached to and from the main body;

wherein an actuating part actuated with the pull operation of the switch lever is provided in the main body; and wherein a detecting part for noncontactly detecting an actuation of the actuating part, and an electric circuit section for actuating an electric device provided at the auxiliary tool based on the detecting actuation of the detecting part, are provided in the auxiliary tool.

2. The electric power tool according to claim 1, wherein the actuating part of the electric power tool main body is a light emitting device and the detecting part of the auxiliary tool is a light-receiving sensor for detecting a light from the light emitting device.

3. The electric power tool according to claim 1, wherein the electric device is a lamp for illuminating a front area of the electric power tool main body.

4. The electric power tool according to claim 1, wherein the auxiliary tool comprises:

a connection part that includes a ring member for tightening a leading end part of the electric power tool main body from outside in a radial direction;

a battery housing part for housing a battery for the electric circuit section, the battery housing part being connected to the connection part so as to be rotatable about an axis; and a bolt-nut mechanism in which a nut rotates in association with rotation of the battery housing part with respect to the connection part and a bolt, engaged with the nut, moves in the axial direction, and in which a tightening force can be applied to the ring member by the movement of the bolt;

wherein a through-hole is formed in the axial direction in the bolt, and lead wires for the electric circuit part are passed through the through-hole.

5. The electric power tool according to claim 4, wherein the lamp is mounted to a part of the connection part, which surrounds a housing of the electric power tool main body from a circumferential direction.

* * * * *